US005962964A

United States Patent [19]

Sano et al.

[11] Patent Number: 5,962,964

[45] Date of Patent: Oct. 5, 1999

[54] CATHODE RAY TUBE APPARATUS

[75] Inventors: Yuuichi Sano; Masahiro Yokota, both of Saitama-ken, Japan

[73] Assignee: Kabushiki Kaisha Toshiba, Kawasaki, Japan

[21] Appl. No.: 08/933,364

[22] Filed: Sep. 18, 1997

[30] Foreign Application Priority Data

Sep. 18, 1996 [JP] Japan ..... P08-246476
Aug. 15, 1997 [JP] Japan ..... P09-220345

[51] Int. Cl.[6] ..... H01J 29/70

[52] U.S. Cl. ..... 313/440; 313/477 R

[58] Field of Search ..... 313/440, 477 R; 220/21 A, 21 R

[56] References Cited

U.S. PATENT DOCUMENTS

| | | | |
|---|---|---|---|
| 3,731,129 | 5/1973 | Tsuneta et al. . | |
| 4,754,190 | 6/1988 | Hinotami et al. | 313/422 |
| 5,155,411 | 10/1992 | Swank et al. | 313/477 R |
| 5,258,688 | 11/1993 | Fondrik | 313/477 R |
| 5,319,280 | 6/1994 | Vriens | 313/413 |
| 5,565,731 | 10/1996 | Han | 313/440 |

*Primary Examiner*—Sandra O'Shea
*Assistant Examiner*—Michael J. Smith
*Attorney, Agent, or Firm*—Oblon, Spivak, McClelland, Maier & Neustadt, P.C.

[57] ABSTRACT

A cathode ray tube apparatus having a vacuum enclosure defined by a neck extending into a yoke portion and further extending into a panel including a screen, wherein a deflection yoke is fixed on the outer surface of the yoke portion which is formed between the screen and the neck of a vacuum enclosure. According to the invention, if the cross-sectional configuration of the yoke portion perpendicular to the tube axis at a reference deflection position is non-circular, e.g., barrel-like or rectangle-like, the aspect ratio of scanning of the screen is M:N, lengths LA, SA and DA are defined between a tube axis and intersection points of horizontal, vertical and diagonal axes and the outer periphery of the yoke portion at the reference deflection position, the following equation is established:

$$(M+N)/2(M^{2+}N^{2})^{1/2} < (SA+LA)/(2DA) \leqq 0.86$$

whereby sufficient anti-implosion strength is achieved with reduced deflection power consumption.

7 Claims, 6 Drawing Sheets

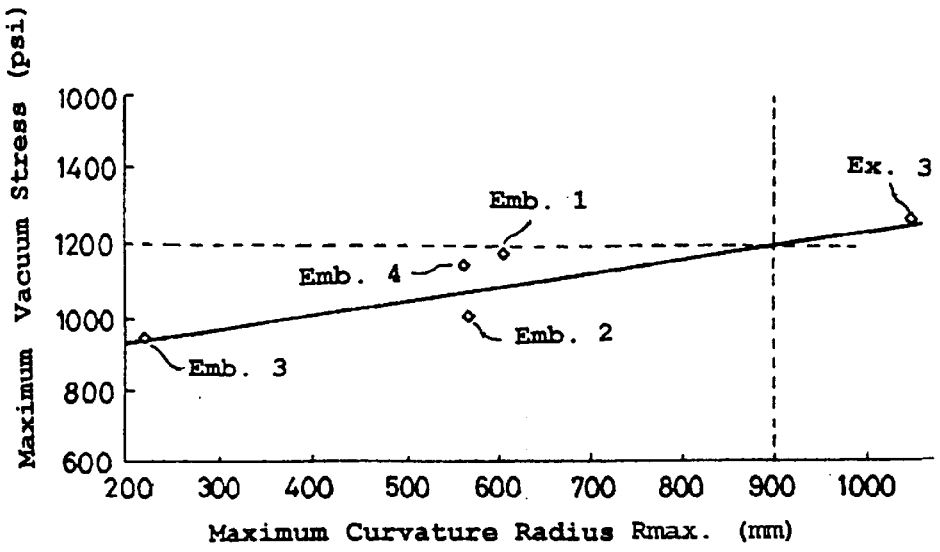
Figure 5
Figure 6(a)
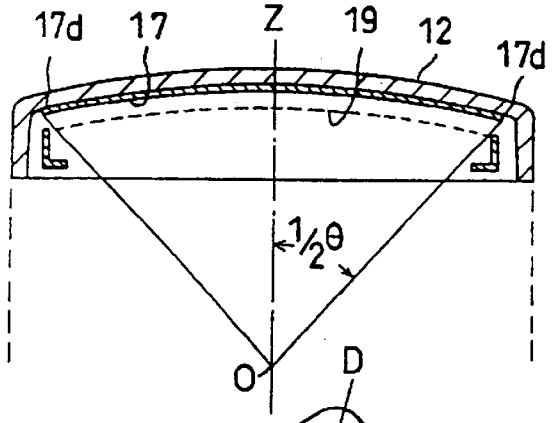
Figure 6(b)
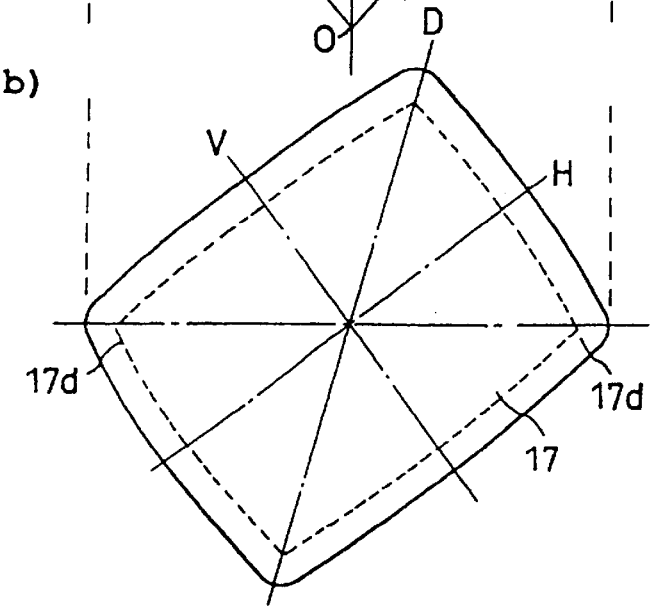

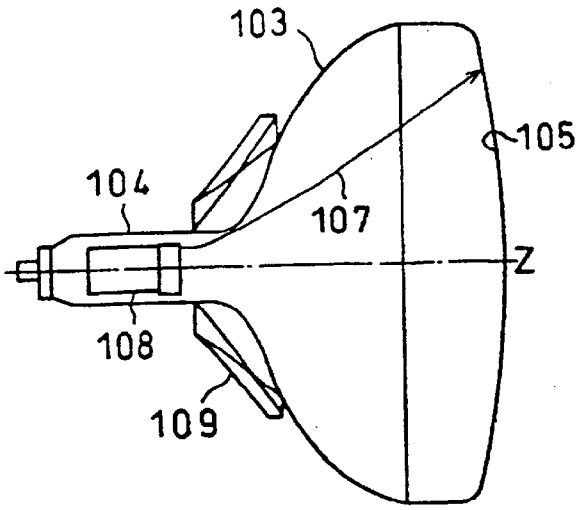
Figure 9(a)
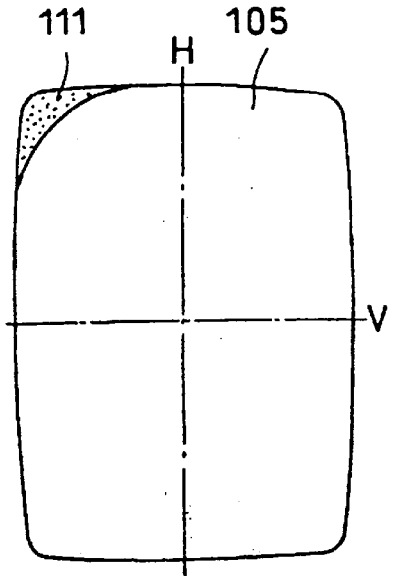
Figure 9(b)
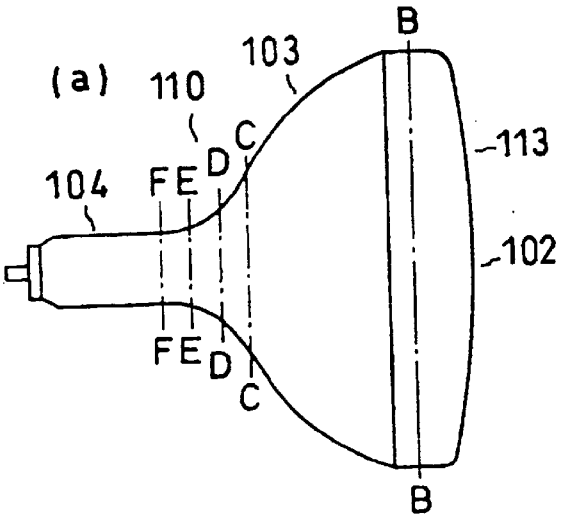
Figure 10(a)
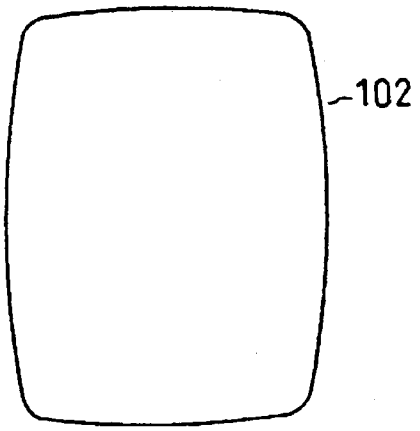
Fifure 10(b)

CATHODE RAY TUBE APPARATUS

BACKGROUND OF THE INVENTION

1. Field of the Invention

This invention relates to a cathode ray tube apparatus and, more particularly, to a cathode ray tube apparatus having reduced deflection power consumption and a vacuum enclosure which has strong anti-atmospheric pressure strength.

2. Related Art

A conventional color cathode ray tube is shown in FIG. 8 and includes a vacuum enclosure which consists essentially of a glass panel 102 with an approximately rectangular-shaped display screen 101, a glass funnel 103 connected to the panel 102, and a cylindrical glass neck 104 connected to the funnel 103. A deflection yoke 109 is fixed at an outer peripheral section ranging in part from the neck 104 to the funnel 103. The funnel 103 includes the so-called yoke portion 110 which increasing in size from the junction with the neck 104 to the side of the funnel 103. The inner surface of the panel 102 is provided with phosphor screen 105 made of three-color phosphor layers of dot-like or stripe-like blue, green and red phosphors. A shadow mask 106 containing a large number of electron beam penetrating apertures is disposed opposite to the phosphor screen 105.

An electron gun 108 is provided to emit three electron beams 107 which are deflected in the horizontal and vertical directions by the horizontal and vertical magnetic fields generated by the deflection yoke 109, and scan, through the shadow mask 106, the phosphor screen 105 in the horizontal and vertical directions to display color images on the display screen 101.

A self-convergence, in-line type electron gun 108 has been widely used to emit the electron beams 107 in a row in a same horizontal plane, with the deflection yoke 109 set to generate a pin cushion type horizontal magnetic field and a barrel type vertical magnetic field so that the electron beams 107 are converged on the phosphor screen 105 over the entire panel 102 without any special correction components.

In a cathode ray tube of this sort, since the deflection yoke 107 is a high power consumption component, it is quite important to decrease power consumed in the deflection yoke 107 for the reduction of power consumption in the cathode ray tube. In practice, however, in order to increase screen brightness, a cathode voltage must eventually be raised to accelerate the electron beams. Further, the deflection frequency must also be high to comply with requirements for high definition TVs, personal computers, and other office automation equipment, resulting in increased power consumption in the deflection yoke.

Recently, strict restrictions have been imposed on leakage magnetic fields from the deflection yokes 109 of cathode ray tubes used for personal computers and other office automation equipment to which operators are always in close proximity. Generally, a compensation magnetic coil is conventionally added to reduce the leakage magnetic fields from the deflection yoke 109 but further increases the power consumption in the cathode ray tube.

It is desirable for a deflection yoke to apply its magnetic field to the electron beams efficiently. For that purpose, the neck of a cathode ray tube is made small in diameter, the deflection yoke fixed portion is made small in configuration, and a deflection magnetic field operating space is made small.

Since in the conventional cathode ray tube, however, the electron beams pass closely along the inner surface of the yoke portion, if the neck 104 is small in diameter and the yoke portion 110 is also made small in configuration, the electron beams emitted toward a diagonal edge of the phosphor screen 105 at the largest deflection angle as shown in FIG. 9(*a*) collide against the inner wall of the yoke portion 110 resulting in a "dead" zone 111 shown in FIG. 9(*b*). In the event that the electron 107 continue to collide with the inner wall, its temperature raises so high to melt the glass inner wall and, eventually, the cathode ray tube is in danger of implosion. It is, therefore, difficult to reduce the deflection power consumption by means of making the neck 104 or the yoke portion 110 small in size.

A countermeasure to solve this problem is described in Japanese Patent Application (Tokkohsho) No. 48-34349 corresponding to U.S. Pat. No. 3,731,129. Briefly, according to this reference, the yoke portion 110 is made rectangular in cross-sectional shape similar to the panel 102. When a rectangular raster is depicted on the phosphor screen, a region at the yoke portion where the electron beams pass through is also rectangular in cross-section. A cathode ray tube 113 shown in FIG. 10(*a*) has cross-sectional shapes taken along lines B—B through F—F shown in FIGS. 10(*b*) through 10(*f*), respectively. The shapes vary gradually from rectangular to circular. The panel 102 and the yoke portion 110 have approximately rectangular cross-sections but the neck 104 has semicircular and circular cross- sections. If the yoke portion 110 is made pyramid-like in configuration as shown, the long and short axes (the horizontal and vertical axes: H-axis and V-axis) of the deflection yoke are made small so that horizontal and vertical deflection coils of the deflection yoke are disposed close to the electron beams. With this structure, the electron beams are effectively deflected and the deflection power consumption, thus, can be reduced.

In such a cathode ray tube, as the cross-section of the yoke portion 110 becomes much closer to a rectangle, the horizontal and vertical axes 115 and 116 and the vicinities thereof are subject to more distortion in dotted-line directions 117 due to the atmospheric pressure F as shown in FIG. 11. The outer peripheries of the horizontal and vertical axes 115 and 116 of the yoke portion 110 receive compressive stress $\sigma H$ and $\sigma V$ while the outer periphery of the diagonal axis 118 and the vicinity thereof receive tensile stress $\sigma D$. As a result, the vacuum enclosure has decreased anti-atmospheric strength and safety.

Further, it is desirable to make the panel as flat as possible in order to avoid outer light reflection thereon and to promote comfortable watching of images. Since that also decreases the strength of the vacuum enclosure, even if a conventional funnel with a pyramid-like deflection yoke portion is used, the strength necessary for safety cannot be always secured.

Because of the reasons set forth above, it is difficult to make the cross-section of the yoke portion rectangular to such extent as to produce sufficient reduction of the deflection power consumption, or, when a rectangular configuration is achieved, the strength of the vacuum enclosure is too weak to apply to a flat panel cathode ray tube.

The assignee of this application developed a technology concerning the pyramid-like shaped yoke portion as mentioned above and commercialized cathode ray tubes to which the technology was applied around 1970. In fact, two series of commercialized cathode ray tube apparatus were: 110° deflection angle, 36.5 mm long neck diameter, and 18', 20', 22' and 26' diagonal lengths and 110° deflection angle, 29.1 mm neck diameter, and 16' and 20' diagonal lengths. At that time, however, the cathode ray tubes had a spherical outer surface panel with an outer curvature radius of about 1.7 times the effective radius of the screen and were called 1R tubes (hereinafter also referred to as the "1R tubes"). The relationship between the configuration of the yoke portion and the vacuum enclosure strength was unknown in the case of cathode ray tubes having panel outer curvature radii 2 times or more the effective radius of the screen.

As set forth above, a reduction of deflection power consumption and a reduction in leakage magnetic field are nowadays required, but it is extremely difficult to comply with those requirements and, at the same time, to achieve high brightness, high frequency cathode ray tubes particularly used for high definition TVs, personal computers and other office automation equipment. Conventionally, it has been proposed that, as a structure to reduce the deflection power consumption, the pyramid-like configuration of the yoke portion varies from a circular cross-section at the neck to a rectangular cross-section at the funnel.

In the past, a cathode ray tube having a vacuum enclosure with sufficient strength as well as satisfactorily reduced deflection power consumption has not successfully been provided. This is particularly true in the case where the vacuum enclosure has a flat panel with an outer curvature radius which is twice the effective radius of its screen.

SUMMARY OF THE INVENTION

Accordingly, an object of this invention is to overcome such technical difficulties as set forth above and to provide a cathode ray tube which has a vacuum enclosure with a pyramid-like shaped yoke portion and yet has sufficient anti-atmospheric pressure strength and reduced deflection power consumption.

A cathode ray tube apparatus of the present invention includes a vacuum enclosure and a deflection yoke fixed on the enclosure. The vacuum enclosure includes a panel having an inner wall including at least a rectangle-shaped phosphor screen, a neck provided with an electron gun therein, and a yoke portion connected to the neck on the screen side thereof. The electron gun is disposed opposite to the phosphor screen. The deflection yoke is fixed on an outer surface region from the yoke portion to the neck. The deflection yoke deflects an electron beam emanated from the electron gun to scan the screen with the aspect ratio of M:N.

The outer curvature radius of the panel is twice the effective diagonal length of the screen, where a circular approximation is assumed for the outer configuration of the panel and the outer curvature radius of the approximating circle is defined based on a difference in a tube axis direction between the center of the screen and diagonal edges of the screen. The yoke portion extends from a connection position of the neck to side edges of the screen, and has outer cross-sections perpendicular to the tube axis. A reference deflection position is located at a rated deflection angle, at which maximum deflection occurs, defined between the tube axis Z and two lines extending from the tube Z to the diagonal edges of the screen. If axial lengths LA, SA, and DA are defined between the tube axis Z and intersections of the horizontal, vertical and diagonal axes and the outer cross-section periphery of the yoke portion at the reference deflection position, respectively, the following equation is established:

$$(M+N)/2(M^2+N^2)^{1/2} < (SA+LA)/2\ DA \leqq 0.86$$

In this case, the outer cross-section of the yoke portion perpendicular to the tube axis at the reference position is substantially a rectangle-like shape similar to that of the screen. In the event that the rectangle-like shape is approximated with arcs of radii Rv, and Rh having centers on the vertical and horizontal axes and an arc of a radius Rd having a center on or close to the diagonal axis, one of the radii Rh and Rv is 900 mm or less.

According to the another aspect of the invention, there is provided a cathode ray tube apparatus which includes a vacuum enclosure which has a panel with an inner wall having at least a rectangle-like shaped phosphor screen, a neck provided with an electron gun therein which is disposed opposite to the phosphor screen, and a yoke portion connected to the neck on the screen side thereof, and a deflection yoke fixed on an outer surface region from the yoke portion to the neck of the vacuum enclosure.

The deflection yoke deflects an electron beam emanated from the electron gun to scan the screen with the aspect ratio of M:N. The outer curvature radius of the panel is twice the effective diagonal length of the screen, a circular approximation is assumed for the outer configuration of the panel to define the outer curvature radius based on a difference in a tube axis direction between the center of the screen and diagonal edges of the screen.

The yoke portion extends from a connection position with the neck to side edges of the screen, and has outer cross-sections 20 perpendicular to the tube axis. A reference deflection position is located at a rated deflection angle defined between two lines extending from the tube axis and the diagonal edge. The outer cross-section of the yoke portion perpendicular to the tube axis at the reference position is substantially a rectangle-like shape similar to that of the screen. In the case that the rectangle-like shape is approximated with arcs of radii Rv, Rh and Rd which have centers on the vertical, horizontal and diagonal axes, respectively, the radius Rd is:

$$5\ \text{mm} \leqq Rd \leqq 15\ \text{mm}.$$

The above-stated and other objects and advantages of the invention will become apparent from the following description when taken with the accompanying drawings. It will be understood, however, that the drawings are for the purposes of illustration and are not to be construed as defining the scope or limits of the invention, reference being had for the latter purpose to the claims appended hereto.

BRIEF DESCRIPTION OF THE DRAWINGS

FIG. 5 is a characteristic graph showing the relationship between the maximum curvature radius and the vacuum stress with respect to embodiments and conventional examples;

FIGS. 6(*a*) and 6(*b*) are cross-sectional and plan views of a display panel to define the center of deflection, respectively;

FIGS. 9(*a*) and 9(*b*) are schematic cross-sectional and plan views of a conventional cathode ray tube, respectively, to explain a problem raised in the case that the radii of its neck and funnel on the neck side are small;

DESCRIPTION OF THE PREFERRED EMBODIMENT

The inventors have researched a deflection characteristic and a stress distribution of a cathode ray tube apparatus which has a vacuum enclosure with a pyramid-like shaped yoke portion and a pyramid-like shaped deflection yoke, and have discovered optimum configurations of a vacuum enclosure for a cathode ray tube apparatus to comply with strength requirements and reduced deflection power consumption.

Figure 4:
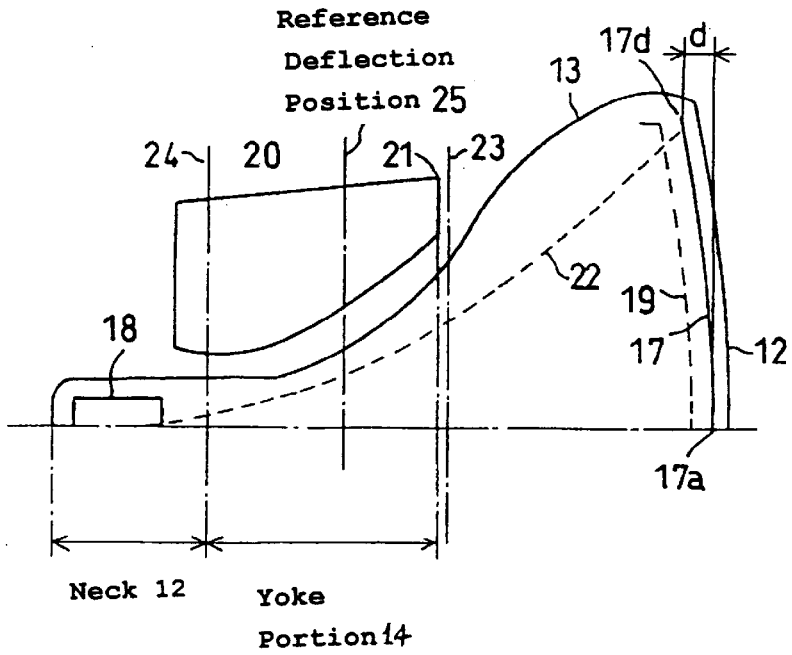
FIG. 4 is a cross-sectional view taken along IV—IV line in FIG. 1, but limited to its upper half.

This invention is applied to a vacuum enclosure with a phosphor screen 17 and having an outer curvature radius which is twice or more the effective radius of the screen, wherein the outer surface of the panel 12 has a flatness approximated by a circle and the outer curvature radius of the approximating circle is defined based on a difference 'd' on the tube axis Z between the center 17*a* and the diagonal end 17*d* of the screen 17, as shown in FIG. 4.

Figure 3:
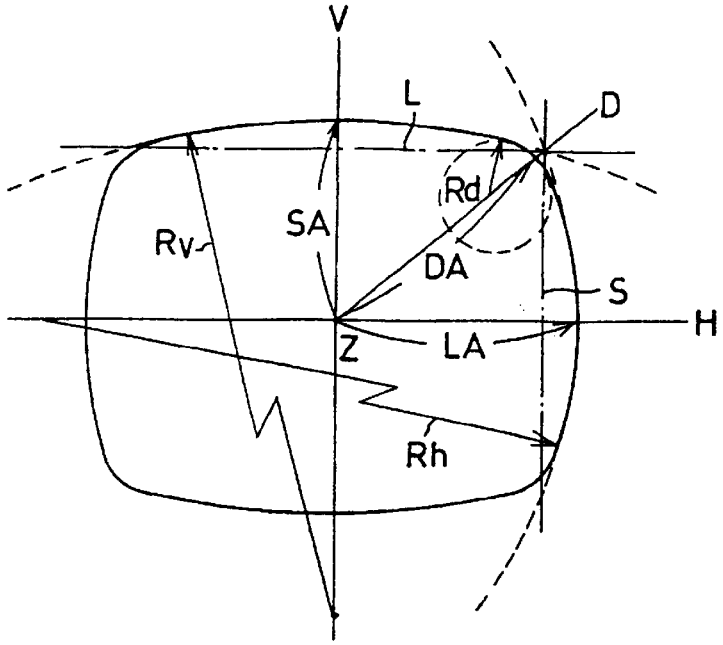
FIG. 3 is a cross-sectional view of the yoke portion perpendicular to the tube axis at a reference deflection position.

FIG. 3 shows a cross-sectional view of a yoke portion taken perpendicular to the tube axis. Lengths LA, SA, and DA are defined between the tube was Z and intersection points of the horizontal, vertical and diagonal axes H, V and D and the outer periphery of the yoke portion, respectively, as shown in FIG. 3. Since in the yoke portion 14, the lengths IA and SA are shorter than the length DA, deflection coils in the vicinity of the vertical and horizontal axes are close to electron beams so that the deflection power consumption is reduced. The diagonal length DA is the longest in the cross section. It is not necessarily consistent with the diagonal axis direction of the screen 12.

In addition to the axial lengths LA, SA, and DA of the axes described above, the cross-sectional sides of the yoke portion are defined by arc curvature radii Rh, Rv and Rd which centers are on the horizontal, vertical and diagonal axes, respectively. Other rectangle-like cross-sections of the yoke portion than the one described above, however, may be made by various equations. As set forth above, the yoke portion is pyramid-like in outer configuration.

It is understood from the above description that the yoke portion cross-section having long and short arcs not closer to the tube axis Z than respective of the long and short sides L and S, is non-circular, barrel-like in shape, for instance as shown in FIG. 3.

As the yoke portion cross-section becomes closer to a rectangle, the vacuum enclosure strength is weaker but the deflection power consumption is more reduced. Here, an index to represent a degree of approximative to a rectangle is defined in the following:

$$(LA+SA)/(2DA) \quad (1)$$

In the case of an ordinary cone-shaped yoke portion, LA=SA=DA and the index is 1.

Where the yoke portion is pyramid-like shaped, the axial length DA remains approximately fixed to a space for the most outer electron beam orbit but both the lengths LA and SA become shorter than in the case of the cone-shaped yoke portion. If it is completely pyramid-like shaped and the aspect ratio of its rectangular cross-section is M:N, then the following equation is established:

$$(M+N)/2(M^2+N^2)^{1/2}<(SA+LA)/(2\ DA) \quad (2)$$

The index is expressed in the form of the shortened peripheral sides of the yoke portion outer periphery. Simulation analyses carried out by the inventors, however, have revealed that substantially the same effect in reduction of the deflection power consumption can be attained even if only one of the horizontal or vertical sides is considered, it then being unnecessary to regard one of the lengths LA and SA as an important factor for the reduction effect, and the index is still useful.

Effects on configurations of the yoke portion along the tube axis have been analyzed. As a result, it has been found that such a region as from the reference deflection position to the screen-side edge 21 of the deflection yoke 20 shown in FIG. 4 is important in regard to the rectangular cross-section thereof.

As shown in FIGS. 6(*a*) and 6(*b*) , the deflection reference position is a deflection center position on the tube axis Z where the maximum deflection angle θ of a cathode ray tube (θ being a rated value corresponding to the angle between maximum deflections of electron beam at the diagonal edges) is defined between two lines drawn from the diagonal edges 17*d* to a point 0 on the tube axis Z.

FIG. 4 shows a path of an electron beam 22 which is emanated toward the diagonal edge 17*d* of the screen 12 under the control of the deflection yoke 20 on the neck side of the yoke portion 14. In the event that the yoke 20 is moved from the deflection reference position 25 to the side of the neck 15, the electron beam 22 is deflected early with strong magnetic field applied on the neck side so that the electron beam collides with the inner walls of the yoke portion 14. When the yoke 20, however, is moved to the side of the screen 17 from the reference position 25, a space or room to avoid the electron beam collision increases around the inner wall. In other words, in the latter case, the neck length is extendable by an amount corresponding to the increase of the room around the inner wall and it is possible to reduce deflection power consumption.

Since, in cathode ray tubes with different neck diameters, differences in the configurations of yoke portions mostly exist up to the reference deflection position 25 but the configurations of the yoke portion on the screen side of the position 25 are about the same, and analysis results are almost identical.

Figure 7:
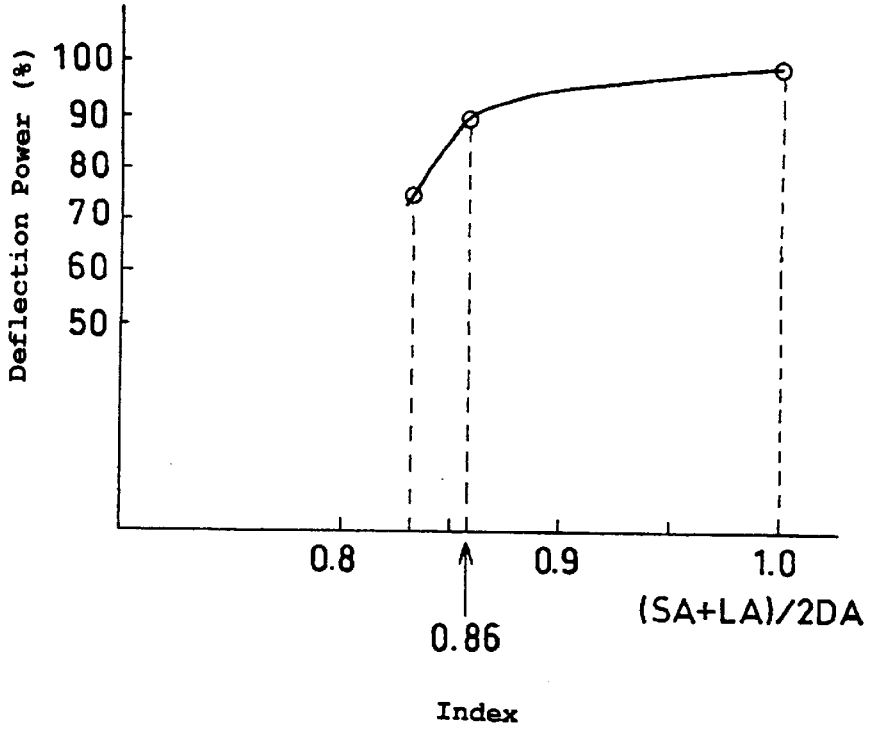
FIG. 7 is a graph to show the relationship between the configurations of the yoke portion an d deflection power consumption.
Figure 8:
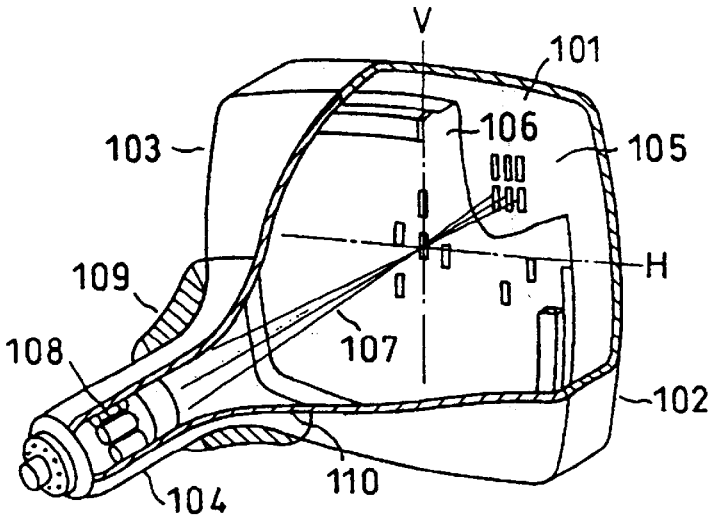
FIG. 8 is a partially cut-out perspective view of a conventional color picture tube.
Figure 10C:
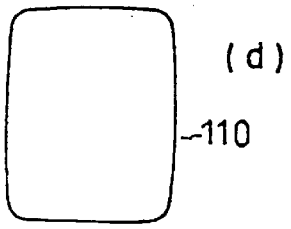
FIG. 10(*a*) through 10(*b*) are schematic diagrams to explain the configurations of a vacuum enclosure of the conventional color cathode ray tube at various cross sections.
Figure 10D:
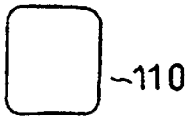
Figure 10E:
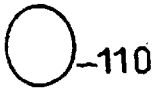
Figure 10F:
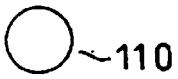
Figure 11:
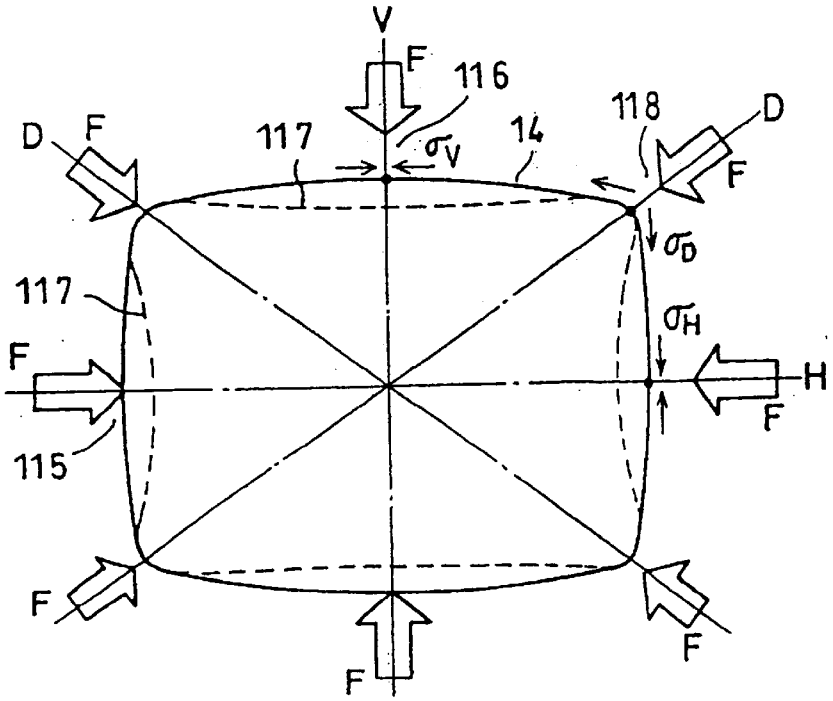
FIG. 11 is a schematic diagram to explain stress taking place with the yoke portion.

First, the effect of reduced deflection power consumption will be explained. FIG. 7 is a graph to show the reduction of the deflection power consumption with respect to the index. Here, the technical specification of the deflection yoke is fixed but data are calculated under the assumption that if the yoke portion is changed in shape, a deflection coil and core of the deflection yoke are deformed closely to fit the yoke portion. Horizontal deflection power is regarded as the deflection power.

As shown, the reduction effect emerges abruptly at the index equal to about 0.86 or less and the deflection power consumption is less by about 10% to 30% than a cone-shaped yoke portion. If the index is 0.86 or more, the reduction effect is 10% or less.

In the case of conventional 1R tubes having 29. 1 mm and 36.5 mm necks with a rectangular cross-section yoke portion, the indices are 0.84 and 0.88, respectively. In short, the indices 0.84 to 0.88 have been achieved with the 1R tubes but flat panel cathode ray tubes do not have a practical advantage unless the reduction effect is 10% or more, i.e., the index is 0.86 or less, in consideration of difficulties associated with a pyramid-like shaped yoke portion and a flat panel because of the severe strength problem to be overcome.

In realization of the index equal to 0.86 or less with a flat panel, the problem is vacuum stress. A flat panel cathode ray tube is necessary to have much lower vacuum stress strength than 1R tubes with a rectangular cross-section yoke portion because a shock strength of the flat panel should be taken into consideration.

Table 1 shows comparison characteristics at the reference deflection position between conventional 1 R tubes and cathode ray tubes of the present invention.

In the 1R tubes, the yoke portion has a bigger curvature radius in the vicinity of the diagonal end portions than the neck. An 1R tube with 29.1 mm neck (example 1) has a flat surface adjacent to the horizontal axis, but an 1R tube with a 36.5 mm neck (example 2) has a small index, i.e., the latter has the disadvantage of small reduction of deflection power consumption.

Of course, as the curvature radius at the diagonal edge portions is shortened, stress increases. Since the most diagonally outer position where the electron beam lands varies in accordance with kinds of deflection yokes and the characteristic dispersion thereof, as the curvature radius is made smaller, the tolerable area of the axial length becomes smaller and the electron beam is apt to collide with the inner wall of the yoke portion.

As a result of stress tests, although dependent on other configurations and factors, if the radius Rd is generally 5mm or more, it is possible to avoid excessive stress concentration and to secure the minimum region for the largest radius of the yoke portion. The radii Rd of embodiments in Table 1 are tolerably set to be 8mm or more.

Examples 1 and 2 are conventional 1R tubes with a rectangular cross-section yoke portions in Table 1. Example 3 is another 1R tube of Example 1 plus a vacuum enclosure with a flat panel having an outer curvature radius which is twice the diagonal radius of a screen. Embodiments 1 through 4 of the invention are cathode ray tubes with flat panels similar to Example 3.

TABLE 1

| Tube | Rh | Rv | Rd | Rmax. | Flat-ness | Strength | Defl. power |
|---|---|---|---|---|---|---|---|
| Example 1 | 206 | 1057 | 15.6 | 1057 | Bad | Good | Good |
| Example 2 | 107 | 124 | 18.3 | 319 | Bad | Good | Poor |
| Example 3 | 206 | 1057 | 15.6 | 1057 | Good | (Bad) | Good |
| Embodiment 1 | 113 | 312 | 8.8 | 601 | Good | Good | Good |
| Embodiment 2 | 101 | 439 | 10.2 | 569 | Good | Good | Good |
| Embodiment 3 | 75 | 174 | 8.7 | 223 | Good | Good | Good |
| Embodiment 4 | 61 | 199 | 9.0 | 223 | Good | Good | Good |

(Unit: mm)

In Table 1, the curvature radii Rh, Rv and Rh define the rectangle-like shaped cross-section at the reference deflection point of the yoke portion while the maximum outer curvature radius Rmax. is the largest outer curvature of the cross-sections of the yoke position. Since the maximum outer curvature radius Rmax., however, is equal to or larger than the radius Rv, the former is on the cross-section located between the reference deflection position 25 and the inflection plane 23.

FIG. 5 shows the maximum curvature radius Rmax. and the maximum vacuum stress in the case of Embodiments 1 through 4 and Example 1. A solid line in FIG. 5 represents a correlation between the maximum curvature radii and the maximum vacuum stress which is inferred in accordance with stress data of Embodiments 1 through 4. Although there is dispersion due to slightly different deflection angles, radii Rd and the like, the maximum vacuum stress, in general, increases as the maximum curvature radius does. In the case that a panel is so flat that the maximum curvature radius is about twice that of a conventional one, the maximum vacuum stress of the vacuum enclosure is empirically 1,200 psi. From the data shown in FIG. 5, if the maximum curvature radius is 900 mm or less, it is analyzed that the maximum stress of the yoke portion is less than 1,200 psi. In the case of Example 3 consisting of the conventional 1R tube (Example 1) to which the flat panel is applied, the maximum vacuum stress is presumably more than 1,200 psi. In short, the design of a conventional 1R tube with a rectangular cross-section yoke potion is difficult to achieve flatness with necessary strength and reduction of deflection power consumption.

Those analyses have been carried out for generally acceptable glass thickness (10 mm through 14 mm at the center of a panel, and 2 mm through 8 mm at a yoke portion where the diagonal edge is thin but the vicinities of the horizontal and vertical axes are thick). 25 As a matter of course, if the glass thickness increases, the vacuum stress reduces. Increased glass thickness is not, however, , a realistic solution from a view point of a cathode ray tube weight.

In summary, as a solution to cope with both of the reduction of the deflection power consumption and the vacuum stress and strength, a yoke portion is provided with the following configuration:

$$(M+N)/2(M^2+N^2)^{1/2}<(SA+LA)/(2DA)\leqq 0.86$$

where a panel has the aspect ratio of M:N, and lengths LA, SA, and DA are defined between the tube axis Z and intersection points of the horizontal, vertical and diagonal axes H, V and D and the outer periphery of the yoke portion, respectively, as shown in FIG. 3. In the yoke portion 14, the lengths LA and SA are shorter than the length DA.

The yoke portion is nearly rectangular in the cross-section perpendicular to the tube axis at the reference deflection position but no side of the rectangle is projected toward the tube axis. In the case that the rectangle is approximated by arcs of the radii Rv, Rh and Rd having centers lying on the vertical, horizontal and diagonal axes, respectively, the radius Rv, or Rh is set to be 900 mm or less and the radius Rd is:

$$5\text{ mm}\leqq Rd\leqq 15\text{ mm}$$

The configuration of the yoke portion set forth above is also applicable not to only a screen with the aspect ratio of 4:3 but also other screens with the aspect ratio of 16:9 and 3:4.

Embodiment 1 (see Table 1) of the present invention is explained hereinafter with reference to FIGS. 1 through 4. FIG. 4 is a schematic sectional view taken along the tube axis Z and the diagonal axis D but only the upper half thereof to which a deflection yoke 20 is added is shown.

This cathode ray tube 10 includes a vacua enclosure 16 provided along the tube axis Z with a glass panel 12 having a display screen which is about rectangular in shape, a glass funnel 13 connected to the panel 12, a yoke portion 14 connected to a smaller radius portion of the funnel 13, and a glass neck 15 connected to the yoke portion 14. A phosphor screen 17 are formed on an inner wall of the panel 12. An electron gun 18 is disposed in the neck 15. The deflection yoke 20 is fixed on the yoke portion 14 and the neck 15. Horizontal and vertical magnetic fields generated by the deflection yoke 20 deflects electron beams emanated from the electron gun 18 in the horizontal and vertical directions. The electron beams scan the phosphor screen in the horizontal and vertical directions through a shadow mask 19 to display images on the display screen.

The yoke portion 14 of the cathode ray tube 10 is particularly pyramid-like in shape. Here, the deflection yoke is the saddle-saddle type which has a little magnetic leakage and vertical and horizontal coils and cores are fixed by a cylinder-shaped frame made of a synthesized resin.

As shown in FIG. 4, the outer peripheral configuration from the neck 15 to the funnel 13 of the vacuum enclosure is a letter S-like shape in cross-section along the tube axis, including a slightly outwardly swelled configuration of the funnel 13 and a slightly inwardly recessed configuration of the yoke portion 14. The boundary between the funnel 13 and the yoke portion 14 is an inflection plane 23. The panel side edge 21 of the deflection yoke 20 is disposed close to the inflection plane 23. The yoke portion 14 is substantially formed at a region from at least a neck connection edge 24 to the panel side edge 21.

Figure 1:
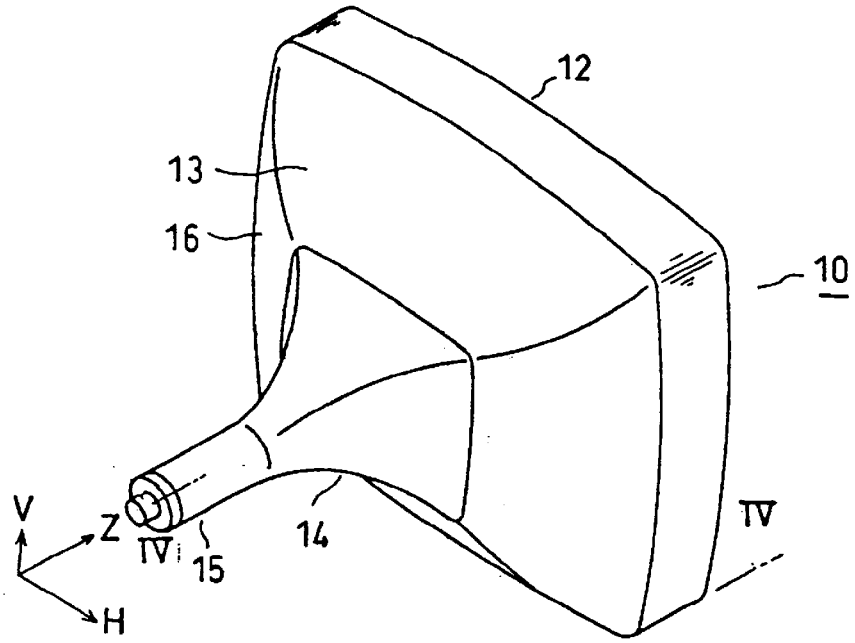
FIG. 1 is a perspective view of a cathode ray tube of one embodiment of the present invention.
Figure 2:
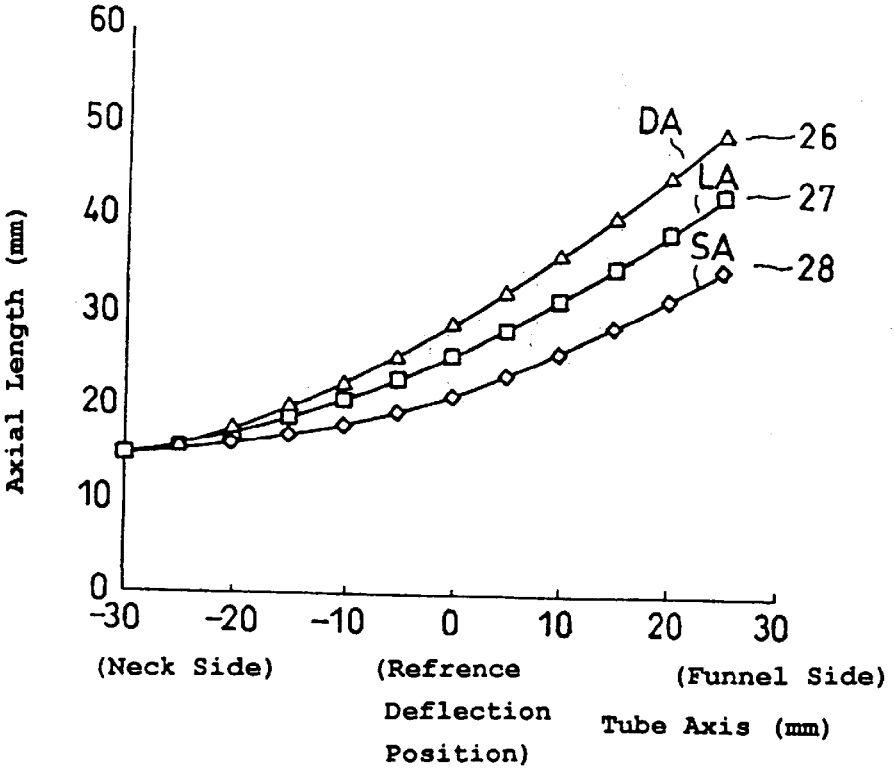
FIG. 2 is a graph to explain the configuration of a yoke portion of the cathode ray tube shown in FIG. 1.

FIG. 2 shows configuration curves of the yoke portion 14 from the neck connection edge 24 to the screen side edge 21. The curves 26, 27 and 28 show changes of the lengths DA, LA and SA of the cross-section in the directions of the diagonal, longer and shorter axes, respectively. Seen from the curves 26, 27 and 28, the yoke portion is approximately circular in shape at the neck 15 and the neck connection edge 24 and the lengths LA and SA in the longer and shorter axes become gradually shorter than the diagonal length DA in the diagonal axis as the position is closer to the side of the screen 17. The yoke portion is approximately rectangular (noncircular) in cross-sectional shape along the tube axis.

In this case, i.e., embodiment 1 of Table 1, the screen 17 has the aspect ratio of M:N=4:3. The yoke portion 14 has the following dimensions at the reference deflection position:

$$DA=28.4 \text{ mm}, LA=25.2 \text{ mm}, \text{ and } SA=21.0 \text{ mm}$$

The index is as follows:

$$(LA+SA)/(2DA)=0.81$$

The deflection power consumption is about 25% less than that of the cathode ray tube with the cone-shaped yoke portion. The outer curvature radii of the yoke portion in the cross-section at the reference deflection position are:

$$Rh=113 \text{ mm}, Rv=312 \text{ mm}, \text{ and } Rd=8.8 \text{ mm}$$

The maximum vacuum stress of the yoke portion is 1,170 psi so that there is no problem with its strength. Further, the glass thickness of the yoke portion is 2.5 mm through 2.8 mm on the diagonal axis, and 2.5 mm through 5.7 mm on the long and short axes. The glass thickness at the center of the panel is 12.5 mm. Embodiment 1 is, thus, equivalent to cathode ray tube 3-n the mass-production and it has no weight problem.

Embodiment 2 in Table 1 is a cathode ray tube with the aspect ratio of M:N=4:3 and the dimensions thereof at the reference deflection position are:

$$DA=29.9 \text{ mm}, LA=26.7 \text{ mm}, \text{ and } SA=22.3 \text{ mm } (LA+SA)/(2DA)=0.82$$

The deflection power consumption is about 22% less than that of the cathode ray tube with the cone-shaped yoke portion. The outer curvature radii of the yoke portion in the cross-section at the reference deflection position are:

$$Rh=101 \text{ mm}, Rv=439 \text{ mm}, \text{ and } Rd=10.2 \text{ mm}$$

The maximum vacuum stress of the yoke portion is 1,000 psi so that it has no strength problem.

Embodiment 3 in Table 1 is a cathode ray tube with the aspect ratio of M:N=4:3 and the dimensions thereof at the reference deflective portion are:

$$DA=30.2 \text{ mm}, LA=27.1 \text{ mm}, \text{ and } SA=22.5 \text{ mm } (LA+SA)/(2\ DA)=0.82$$

The deflection power consumption is about 20% less than that of the cathode ray tube with the cone-shaped yoke portion. The outer curvature radii of the yoke portion in the cross-section at the reference deflection position are:

$$Rh=75 \text{ mm}, Rv=174 \text{ mm}, \text{ and } Rd=8.7 \text{ mm}$$

The maximum vacuum stress of the yoke portion is 920 psi so that it has no strength problem.

Embodiment 4 in Table 1 is a cathode ray tube with the aspect ratio of M:N=4:3 and the dimensions thereof at the reference deflective position are:

$$DA=30.2 \text{ mm}, LA=27.5 \text{ mm}, \text{ and } SA=22.5 \text{ mm } (LA+SA)/(2\ DA)=0.83$$

The deflection power consumption is about 17% less than that of the cathode ray tube with the cone-shaped yoke portion. The outer curvature radii of the yoke portion in the cross-section at the reference deflection position are:

$$Rh=61 \text{ mm}, Rv=199 \text{ mm}, \text{ and } Rd=9.0 \text{ mm}$$

The maximum vacuum stress of the yoke portion is 1,140 psi so that it has no strength problem.

The present invention provides a cathode ray tube apparatus with a pyramid-like shaped yoke portion of a vacuum enclosure which has sufficient anti-atmospheric pressure strength and reduces effectively the deflection power consumption and which also complies with requirements for high brightness and high frequency.

What we claim is:

1. A cathode ray tube apparatus comprising:

a vacuum enclosure defining a tube axis Z and including, a panel having a rectangle-shaped phosphor screen and an outer surface which crosses the tube axis at substantially a right angle, a neck provided with an electron gun disposed opposite to said phosphor screen, and a yoke portion connected to said neck;

a funnel portion provided between said yoke portion and said panel and connecting said yoke portion to said panel; and a deflection yoke fixed on an outer surface region from said yoke portion to said neck of said vacuum enclosure, said deflection yoke configured to deflect an electron beam emanated from said electron gun to scan said screen with an aspect ratio of M:N, said panel having an outer curvature radius equal to or greater than twice an effective diagonal length of said screen where a circular approximation is assumed for the outer configuration of said panel and the outer curvature radius is defined based on a difference in a tube axis direction between the center of the screen and diagonal edges of said screen, wherein cross-sections of the yoke portion perpendicular to the tube axis have outer radii between the outer surface of the yoke portion and the tube axis, and at least one of the outer cross-sections of said yoke portion is non-circular and includes a maximum outer radius between vertical and horizontal directions of said screen, wherein a reference deflection position is located at a rated deflection angle defined between two lines extending from the tube axis to the diagonal edges, and wherein axial lengths LA, SA, and DA are defined between the tube axis Z and intersection points of the horizontal, vertical and diagonal axes H, V and D and the outer periphery of the yoke portion in a plane perpendicular to the tube axis at the reference deflection point, respectively, and wherein the following equation is established:

$$(M+N)/2(M^2+N^2)^{1/2} < (SA+LA)/(2DA) \leqq 0.86$$

whereby sufficient anti-implosion strength is achieved with reduced deflection power consumption.

2. The cathode ray tube apparatus according to claim 1, wherein the outer cross-section of said yoke portion perpendicular to the tube axis at the reference deflection point is substantially of a rectangle-like shape similar to that of said screen, wherein said rectangle-like shape is approximated with arcs of radii Rv and Rh having centers which are on the vertical and horizontal axes and an arc of a radius Rd having a center which is on or close to a line connecting a point of the maximum outer radius to the tube axis, and one of said radii Rh and Rv is 900 mm or less.

3. The cathode ray tube apparatus according to claim 2, wherein $$5\text{ mm} \leqq Rd \leqq 15\text{ mm}.$$

4. The cathode ray tube apparatus according to claim 1, wherein the outer cross-section of said yoke portion perpendicular to the tube axis at the reference deflection position is substantially a rectangle-like shape similar to said screen, wherein said rectangle-like shape is approximated with arcs of curvature radii Rv and Rh having centers which are on the vertical and horizontal axes and an arc of a radius Rd having a center on or close to a line connecting a point of the maximum outer radius to the tube axis, and $$5\text{ mm} \leqq Rd \leqq 15\text{ mm}.$$

5. The cathode ray tube apparatus according to claims 1, 2, 3 or 4, wherein a funnel is provided between said panel and said yoke portion.

6. The cathode ray tube apparatus according to claims 2, 3 or 4, wherein the outer cross-section of said yoke portion is a barrel-like shape.

7. The cathode ray tube apparatus according to claim 5, wherein the vacuum enclosure between the neck and the funnel has an outer surface which in cross-section has an S-like shape, and a boundary between said yoke portion and said funnel is an inflection plane occurring along the tube axis at an inflection in said S-like shape.

* * * * *